US011905950B2

(12) United States Patent
Hall et al.

(10) Patent No.: US 11,905,950 B2
(45) Date of Patent: Feb. 20, 2024

(54) SCREW PUMP WITH IMPROVED SEALING AND BEARING ASSEMBLY

(71) Applicant: CIRCOR PUMPS NORTH AMERICA, LLC., Monroe, NC (US)

(72) Inventors: Victor Hall, Camden, SC (US); Dennis Fowler, Monroe, NC (US); Vasanth Krishnasamy, Chennai (IN); Simon Bradshaw, Glasgow (GB); Axel Jaeschke, Lehrte (DE)

(73) Assignee: CIRCOR PUMPS NORTH AMERICA, LLC., Monroe, NC (US)

( * ) Notice: Subject to any disclaimer, the term of this patent is extended or adjusted under 35 U.S.C. 154(b) by 0 days.

(21) Appl. No.: 17/791,990

(22) PCT Filed: Jan. 24, 2020

(86) PCT No.: PCT/US2020/014918

§ 371 (c)(1),
(2) Date: Jul. 11, 2022

(87) PCT Pub. No.: WO2021/150240

PCT Pub. Date: Jul. 29, 2021

(65) Prior Publication Data

US 2023/0052329 A1 Feb. 16, 2023

(51) Int. Cl.

| | |
|---|---|
| ***F01C 19/00*** | (2006.01) |
| ***F03C 2/00*** | (2006.01) |
| ***F03C 4/00*** | (2006.01) |
| ***F04C 2/00*** | (2006.01) |

(Continued)

(52) U.S. Cl.
CPC ..... *F04C 15/0038* (2013.01); *F04C 2/16* (2013.01); *F04C 2230/602* (2013.01);
(Continued)

(58) Field of Classification Search
CPC ..... F04C 2/16; F04C 18/16; F04C 15/0026; F04C 15/0038; F04C 15/0088;
(Continued)

(56) References Cited

U.S. PATENT DOCUMENTS 4,181,474 A 1/1980 Shaw
4,990,069 A * 2/1991 Guittet ..... F04C 27/009 418/104

(Continued)

OTHER PUBLICATIONS

Supplementary European Search Report for European Application No. EP20915688, dated Jan. 20, 2023, 11 pages.

(Continued)

*Primary Examiner* — Theresa Trieu
(74) *Attorney, Agent, or Firm* — KDW Firm PLLC

(57) ABSTRACT

An improved screw pump such as, for example, a twin screw pump, includes a casing including an internal chamber, and first and second rotors rotatably positioned within the chamber of the casing. The first and second rotors have an intermeshing threaded-shape profiling. A plurality of bearing seal assemblies are provided at each end of the first and second rotors. Each bearing seal assembly includes a bearing positioned about an end portion of a rotor to facilitate rotation of the rotor, and a seal positioned about an end portion of a rotor to seal passage of the rotor through the casing. The bearing is coupled to the seal so that the seal may be secured to the casing via the coupling of the bearing to the casing.

12 Claims, 10 Drawing Sheets

(51) Int. Cl.
*F04C 15/00* (2006.01)
*F04C 2/16* (2006.01)

(52) U.S. Cl.
CPC ..... *F04C 2240/30* (2013.01); *F04C 2240/50* (2013.01); *F04C 2240/805* (2013.01)

(58) Field of Classification Search
CPC ..... F04C 2230/60; F04C 2230/602; F04C 2240/30; F04C 2240/50; F04C 2240/56; F04C 2240/60; F04C 2240/805; F01C 19/005; F01C 19/125; F01C 21/02
See application file for complete search history.

(56) References Cited

U.S. PATENT DOCUMENTS

| | | | |
|---|---|---|---|
| 5,662,463 | A | 9/1997 | Mirzoev et al. |
| 5,722,163 | A | 3/1998 | Grant |
| 6,095,780 | A | 8/2000 | Ernens |
| 6,287,100 | B1 | 9/2001 | Achtelik |
| 2001/0021349 | A1 | 9/2001 | Nishimura |
| 2002/0141893 | A1 | 10/2002 | Hoshino |
| 2015/0110610 | A1 | 4/2015 | Swartzlander |
| 2017/0130719 | A1 | 5/2017 | Jang |
| 2017/0306958 | A1 | 10/2017 | Miyatake |

OTHER PUBLICATIONS

International Search Report and Written Opinion dated Apr. 1, 2020, for the International Patent Application No. PCT/US20/14918, filed on Jan. 24, 2020, 6 pages.

* cited by examiner

SCREW PUMP WITH IMPROVED SEALING AND BEARING ASSEMBLY

This application is a national stage filing under 35 U.S.C. 371 of pending International Application No. PCT/US2020/014918, filed Jan. 24, 2020, titled "SCREW PUMP WITH IMPROVED SEALING AND BEARING ASSEMBLY" the entirety of which-application is incorporated by reference herein.

FIELD OF THE DISCLOSURE

The present disclosure relates generally to screw pumps such as, for example, twin screw pumps, and more particularly to screw pumps incorporating a sealing and bearing assembly to facilitate assembly, disassembly, and maintenance.

BACKGROUND OF THE DISCLOSURE

Screw pumps such as, for example twin screw pumps, are well-known. In use, screw pumps enable efficient fluid flow through the pump. Referring to FIGS. 1 and 2, as will be readily appreciated by one of ordinary skill in the art, a screw pump 10 such as, for example, a twin screw pump, includes a casing, housing, body, etc. 20 (terms used interchangeably herein without the intent to limit). As illustrated, the casing 20 may include an internal chamber 22, one or more inlets 24, and one or more outlets 26. For example, as illustrated, the screw pump 10 may include a center inlet 24 and a center outlet 26. However, while a particular embodiment of a screw pump 10 is illustrated, one of ordinary skill in the art will appreciated that numerous variations are possible. For example, a screw pump may include a side inlet and a top (center) outlet. Alternatively, a screw pump may include a center inlet and a center outlet. Moreover, a screw pump may include a single inlet positioned, for example, in the center, and multiple outlets positioned, for example, at the ends. Alternatively, the pump may include a single outlet and multiple inlets. In addition, the casing 20 may include one or more end or cover plates 28. As will be appreciated by one of ordinary skill in the art, the casing may include various components such as, for example, one or more cover plates. For sake of brevity, as used herein, casing includes the main body and associated components coupled thereto such as the casing cover plates.

In addition, as shown, the screw pump 10 includes two, interlocking rotatable screws, rotors, etc. 30 (terms used interchangeably herein without the intent to limit) positioned within the chamber 22 of the casing 20. Each rotor 30 includes at least one threaded-shaped profiling 32. In use, the threaded-shaped profiles 32 formed on a first rotor 30 intermeshes with an adjacent threaded-shaped profile 32 formed on a second rotor 30. In use, the rotors 30 are arranged and configured to rotate in opposite directions so that fluid entering the inlet 24 may be moved axially within the chamber 22 along the longitudinal axes of the rotors 30 until the fluid exits the casing 20 via the outlet 26. During rotational movement of the rotors 30, the individual delivery chambers formed between the intermeshing threaded-shape profiles 32 migrate, as it were, in the axial direction thereby continuously conveying the fluid in the chamber 22.

In addition, as will be appreciated by one of ordinary skill in the art, screw pumps 10 are complex machines incorporating a number of different components. In particular, with regards to the present disclosure, as illustrated in FIG. 2, screw pumps 10 include, inter alia, bearings 50 operatively associated with the rotors 30 to facilitate rotation of the rotors 30 and seals 60 operatively associated with the rotors 30 to prevent liquid from escaping from the casing 20.

Generally speaking, a twin screw pump 10 includes four (4) mechanical seals 60 and four (4) bearings 50 (i.e., a seal and a bearing on either end of each rotor). As illustrated, the seals 60 are positioned inboard of the bearings 50. In addition, as generally illustrated, the seals 60 each include a mounting flange 62 to facilitate fastening (e.g., bolting) of the seals 60 to the casing 20, or a cover plate 28 associated therewith (collectively referred herein as to the casing). Similarly, the bearings 50 each include a mounting flange 52 to facilitate fastening (e.g., bolting) of the bearing 50 to the casing 20. Thus arranged, a number of challenges are created.

By independently coupling the bearings 50 and the seals 60 via flanges 52, 62, respectively, to the casing 20 and by positioning the seals 60 inboard of the bearings 50, the size and configuration of the seals 60 and accompany flange 62 prevent the seals 60 from being removed and/or replaced through the mounting or access location of the bearing 50. Thus, in order to remove and/or replace one of the seals 60, the bearings 50 must be initially removed (e.g., to remove a seal 60, both bearings 52 on one side of the screw pump 10 must be removed together with their locating casing 25). That is, to remove and/or replace a seal, the entire side of the screw pump needs to be disassembled in order to provide approximate access to the seal and mounting flange. Thus adding complexity, cost and time to maintenance.

Some screw pumps have tried to mitigate this concern by attempting to improve access to the seals 60 by utilizing a common housing for both bearings (e.g., utilizing a common housing to hold the bearing for the first rotor and the bearing for the second rotor). However, removing a single seal still necessitates removal of both bearings.

In addition, utilizing flanges 62 to couple the seal 60 to the casing 20 creates the need for two separate flanges 52, 62 for each end of the rotor 30 (e.g., a first flange 52 is utilized to secure the bearing 50 and a second flange 62 is utilized to secure the seal 60). Thus arranged, the axial space between the bearings 50 positioned on opposite ends of the same rotor 30 is increased, which results in an increased span or distance between bearings 50 causing increased deflection of the rotor 30, which must be designed and accommodated for.

In addition, in order to adjust the axial position of the rotors relative to each other, a shim 64 may be used between the thrust bearing and the rotor screw shaft or housing. However, this requires positioning of the bearing, measurement of the axial position of the shaft, and then removal of the bearing in order to insert the shim.

The object of the invention is therefore to provide a screw pump that overcomes the current disadvantages.

SUMMARY OF THE DISCLOSURE

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

An improved bearing seal assembly for use with, inter alia, a screw pump is disclosed. Screw pumps such as, for example, twin screw pumps, include a casing and twin, intermeshing rotors positioned within the casing. The screw pumps also include a plurality of bearings to facilitate rotation of the rotors and seals to prevent fluid leakage between the rotors and the casing.

In accordance with one aspect of the present disclosure, in one embodiment, the bearing and seal are provided in a bearing seal assembly. That is, in one embodiment, the seal may be operatively coupled or associated with the bearing. Thus arranged, the seal is devoid of a mechanical flange commonly used to fasten or bolt the seal to the casing. Rather, in accordance with the bearing seal assembly of the present disclosure, the seal is secured to the casing via transfer of pressure from the bearing. That is, in one embodiment, the seal may be coupled or associated with the bearing, which may be secured (e.g., fastened) to the casing. As such, the seal may be secured to the casing through the coupling of the bearing to the casing (e.g., separate and independent securement of the seal to the casing is omitted).

In addition, the seal may be sized slightly smaller than the bearing (e.g., the outer diameter of the seal may be slightly smaller than the outer diameter of the bearing) so that the seal can be removed through the space created when the bearing is removed. As such, by eliminating fastening of the seal to the casing and by sizing the seal to be slightly smaller than the bearing, removal of the seal through the space created by removing the bearing is facilitated thereby eliminating, or at least greatly minimizing, collateral disassembly of the screw pump to access the seal.

In one embodiment, the screw pump comprises a casing including an internal chamber, first and second rotors rotatably positioned within the chamber of the casing, the first and second rotors including intermeshing threaded-shape profiling, and a plurality of bearing seal assemblies. The bearing seal assembly positioned at each end of the first and second rotors. In one embodiment, each bearing seal assembly includes a bearing positioned about an end portion of a rotor to facilitate rotation of the rotor, and a seal positioned about an end portion of a rotor to seal passage of the rotor through the casing, wherein the bearing is coupled to the seal so that the seal may be secured to the casing via the coupling of the bearing to the casing.

In one embodiment, the seal is positioned on the end portion of the rotor inboard of the bearing.

In one embodiment, the seal is not separately and independently fastened to the casing.

In one embodiment, the seal includes an axially extending projection and the bearing is arranged and configured to receive the axially extending projection.

In one embodiment, the seal includes an outer diameter and the bearing includes an outer diameter, the outer diameter of the seal is less than the outer diameter of the bearing.

In one embodiment, the seal is accessible via an access space created by removal of the bearing.

In one embodiment, the seal and the bearing are arranged and configured to be removed from the casing in unison.

In one embodiment, the screw pump further comprises a shim positioned between the bearing and the casing, the shim being arranged and configured to adjust an axial position of a rotor.

In one embodiment, the screw pump further comprises one or more additional shims positioned between the seal and the bearing, the one or more additional shims arranged and configured to control a position of the seal.

In one embodiment, the bearing includes a bearing pod having a flange arranged and configured to receive a plurality of fasteners for coupling the bearing seal assembly to the casing.

In one embodiment, the bearing pod includes a cavity sized and configured to receive the bearing therein.

In one embodiment, the seal includes an axially extending projection, the axially extending projection is received within a bore formed in the bearing pod.

In one embodiment, the flange is positioned at one end of the bearing pod, the bore for receiving the axially extending projection is positioned at an opposite end of the bearing pod from the flange.

BRIEF DESCRIPTION OF THE DRAWINGS

By way of example, a specific embodiment of the disclosed device will now be described, with reference to the accompanying drawings, in which:

FIG. 8 is show with the rotor removed;

Figure 1:
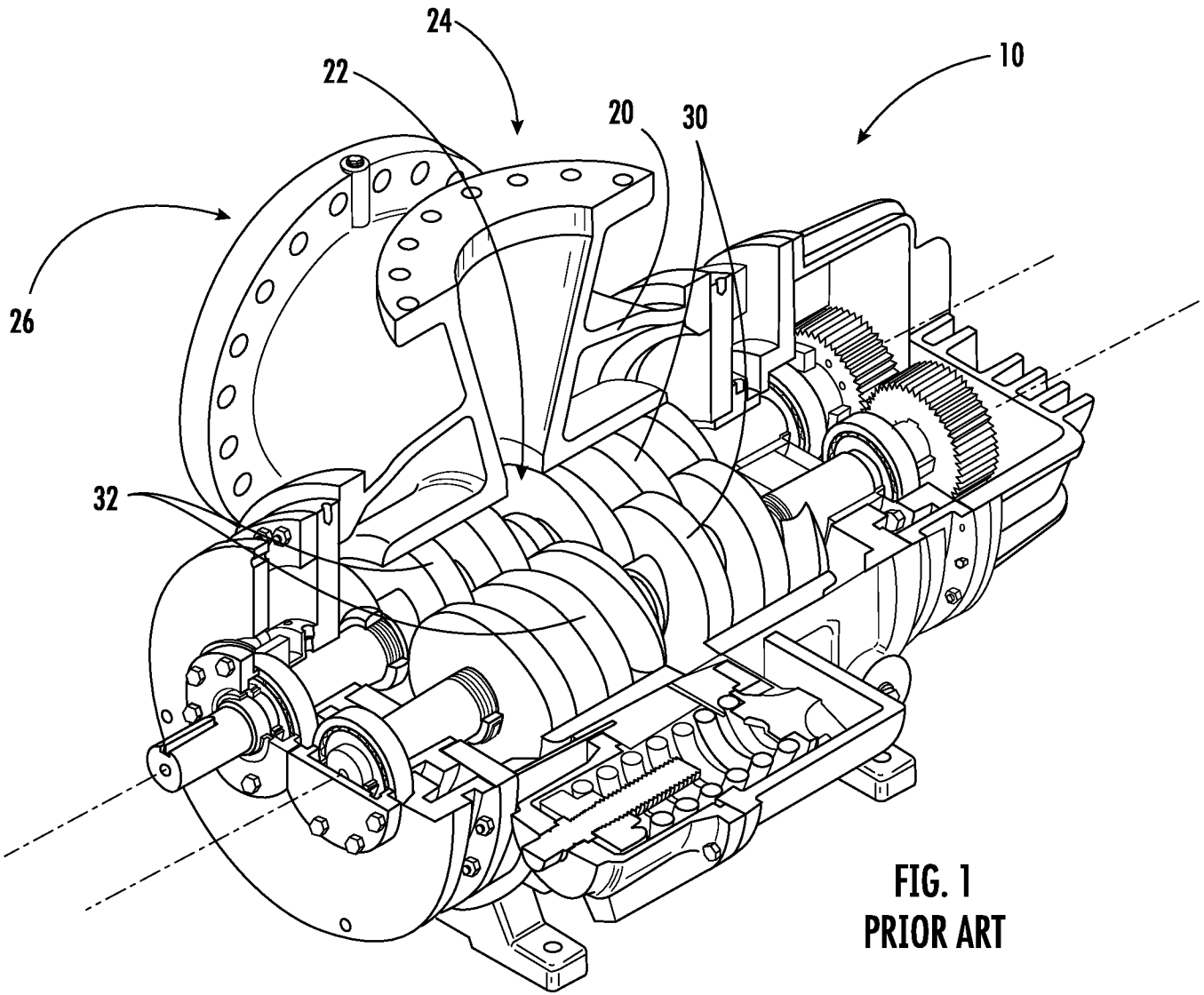
FIG. 1 PRIOR ART
FIG. 1 is a perspective view of a known screw pump, the pump's casing show partially removed to illustrate internal components of the screw pump.
Figure 2:
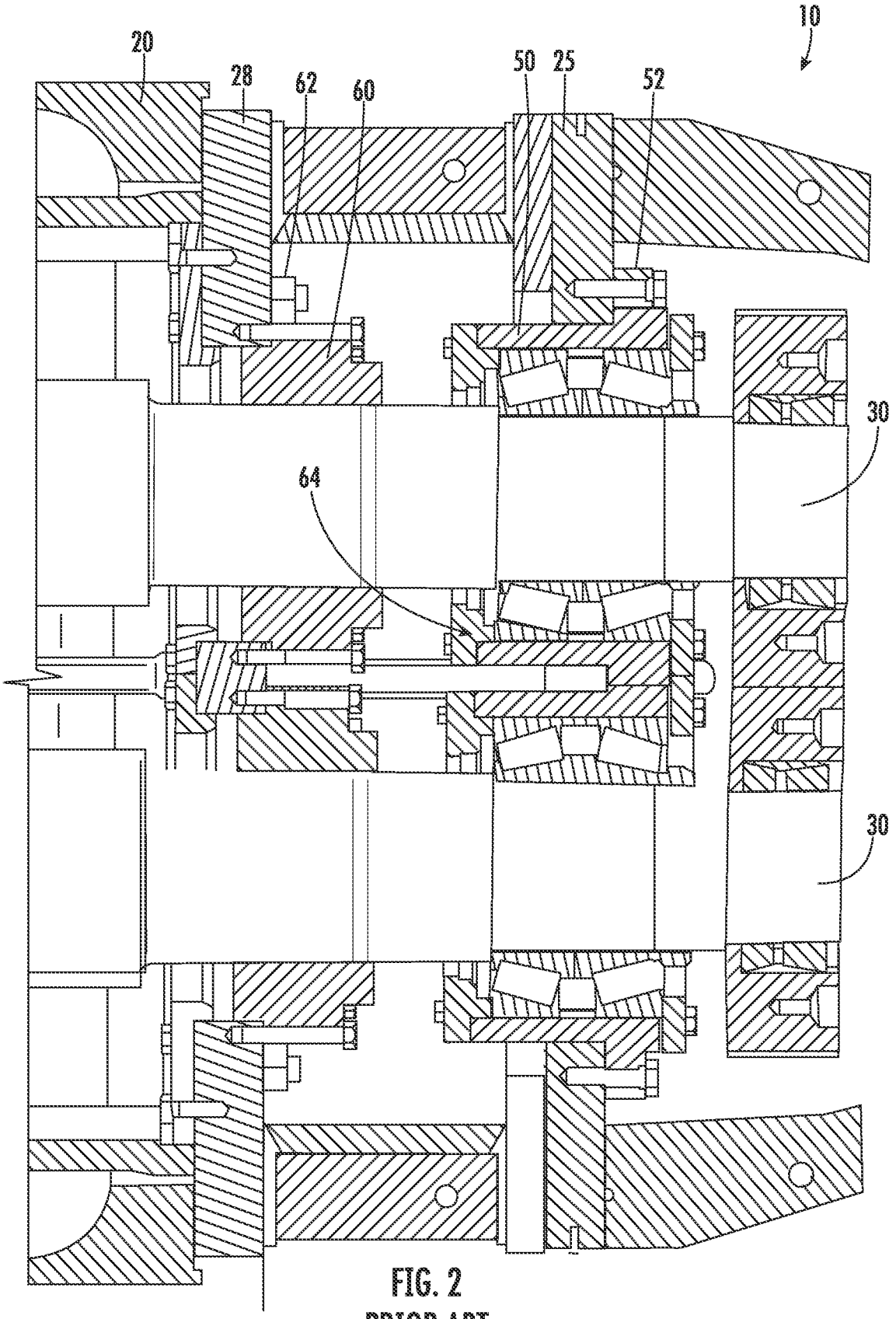
FIG. 2 PRIOR ART
FIG. 2 is a detailed representation of an end of the screw pump shown in FIG. 1, FIG. 2 illustrating a known bearing and seal arrangement.

The drawings are not necessarily to scale. The drawings are merely representations, not intended to portray specific parameters of the disclosure. The drawings are intended to depict example embodiments of the disclosure, and therefore are not be considered as limiting in scope. In the drawings, like numbering represents like elements.

DETAILED DESCRIPTION

Numerous embodiments of improved screw pumps in accordance with the present disclosure will now be described more fully hereinafter with reference to the accompanying drawings, in which preferred embodiments of the present disclosure are presented. The screw pump of the present disclosure may, however, be embodied in many different forms and should not be construed as being limited to the embodiments set forth herein. Rather, these embodiments are provided so that this disclosure will convey certain example aspects of the screw pump to those skilled in the art. In the drawings, like numbers refer to like elements throughout unless otherwise noted.

As will be described in greater detail below, in accordance with one or more aspects of the present disclosure, a screw pump such as, for example, a twin screw pump, includes an improved bearing and seal assembly. In one example of an embodiment, the bearing and seal assembly includes a bearing and a seal wherein the bearing is operatively associated with the seal so that the seal may be secured to the casing via the coupling of the bearing to the casing. That is, in one embodiment, load (e.g., pressure) associated with coupling the bearing to the casing is transferred to the seal to secure the position of the seal relative to the casing. Thus arranged, the mechanical flange used to secure the seal to the casing is omitted (e.g., the seal is not independently bolted to the casing via a flange). As a result, the seal can be accessed, and/or removed and replaced with reduced collateral disassembly (e.g., the seal can be accessed, removed, and/or replaced via the opening formed when the bearing is removed).

As will be described herein, the aspects and features according to the present disclosure may be used with any suitable screw pump now known or hereafter developed. As such, details regarding construction and operation of the screw pump are omitted for sake of brevity of the present disclosure. In this regard, the present disclosure should not be limited to the details of the screw pump disclosed and illustrated herein unless specifically claimed and that any suitable screw pump can be used in connection with the principles of the present disclosure.

Referring to FIGS. 3-8, an example of an embodiment of a screw pump 100 is disclosed. In accordance with one aspect of the present disclosure, the screw pump 100 includes a casing 120, first and second rotors 130, a bearing 150 associated with each end of the rotor 130 positioned about the shaft of the rotor 130 to facilitate rotation of the rotor 130, and a seal 160 associated with each end of the rotor 130 positioned between the shaft of the rotor 130 and a portion of the casing 120 to prevent leakage of fluid and/or air through the opening formed in the casing 120 to enable the rotor 130 to pass therethrough.

Figure 3:
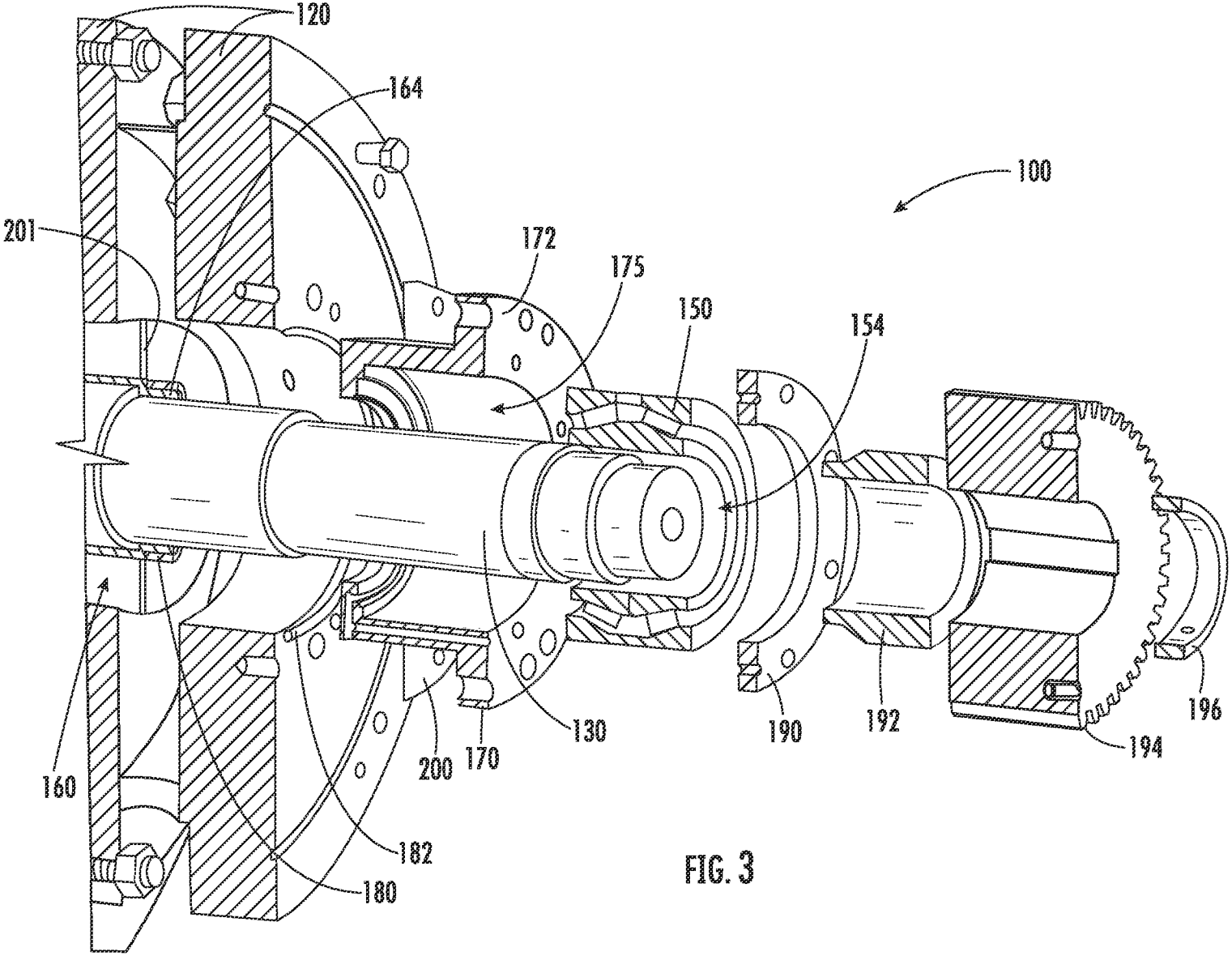
FIG. 3 is an exploded, detailed perspective of an example of an embodiment of a bearing seal assembly that may be used in the screw pump shown in FIG. 1 in accordance with one aspect of the present disclosure.
Figure 4:
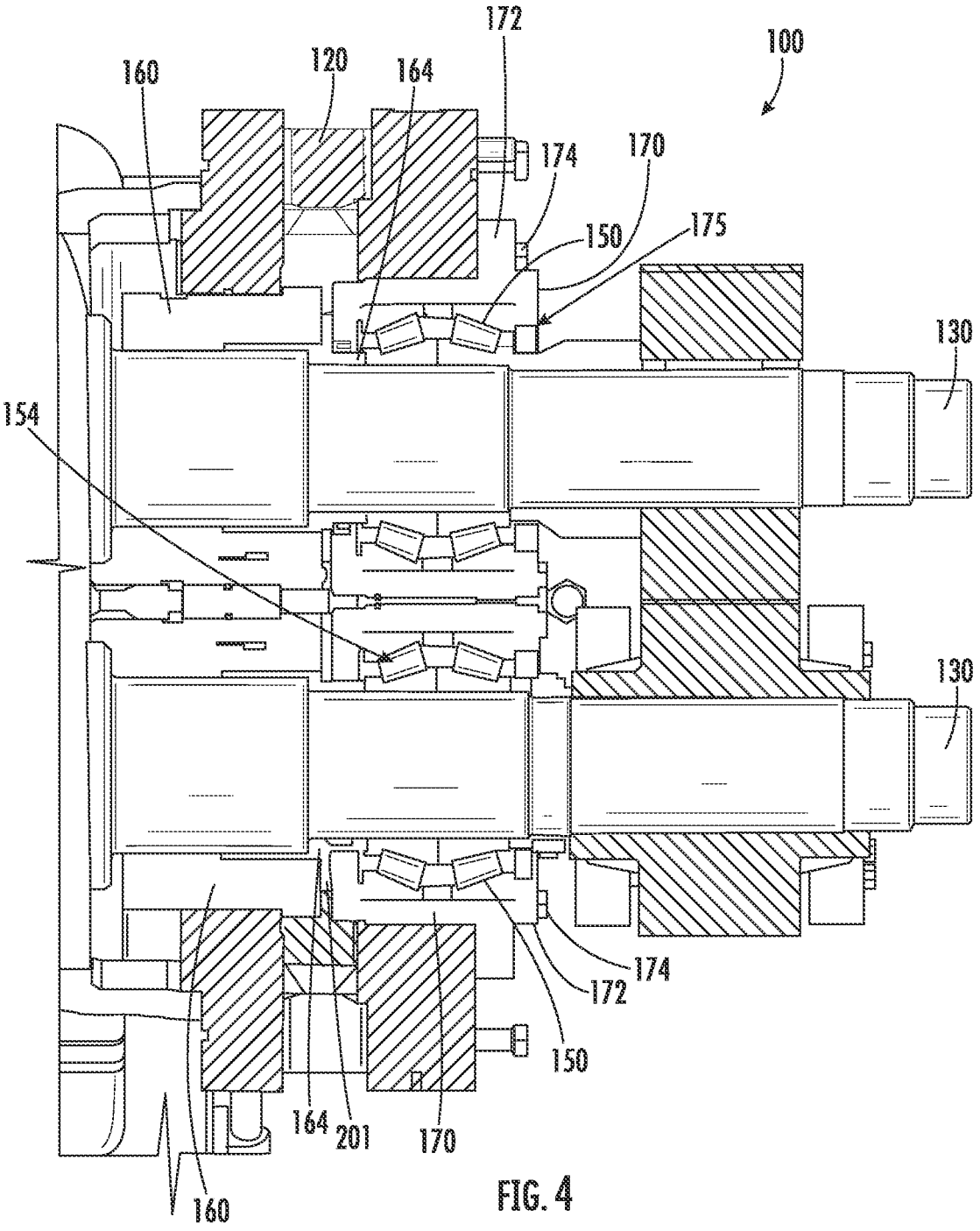
FIG. 4 is a detailed view of the bearing seal assembly shown in FIG. 3.
Figure 5:
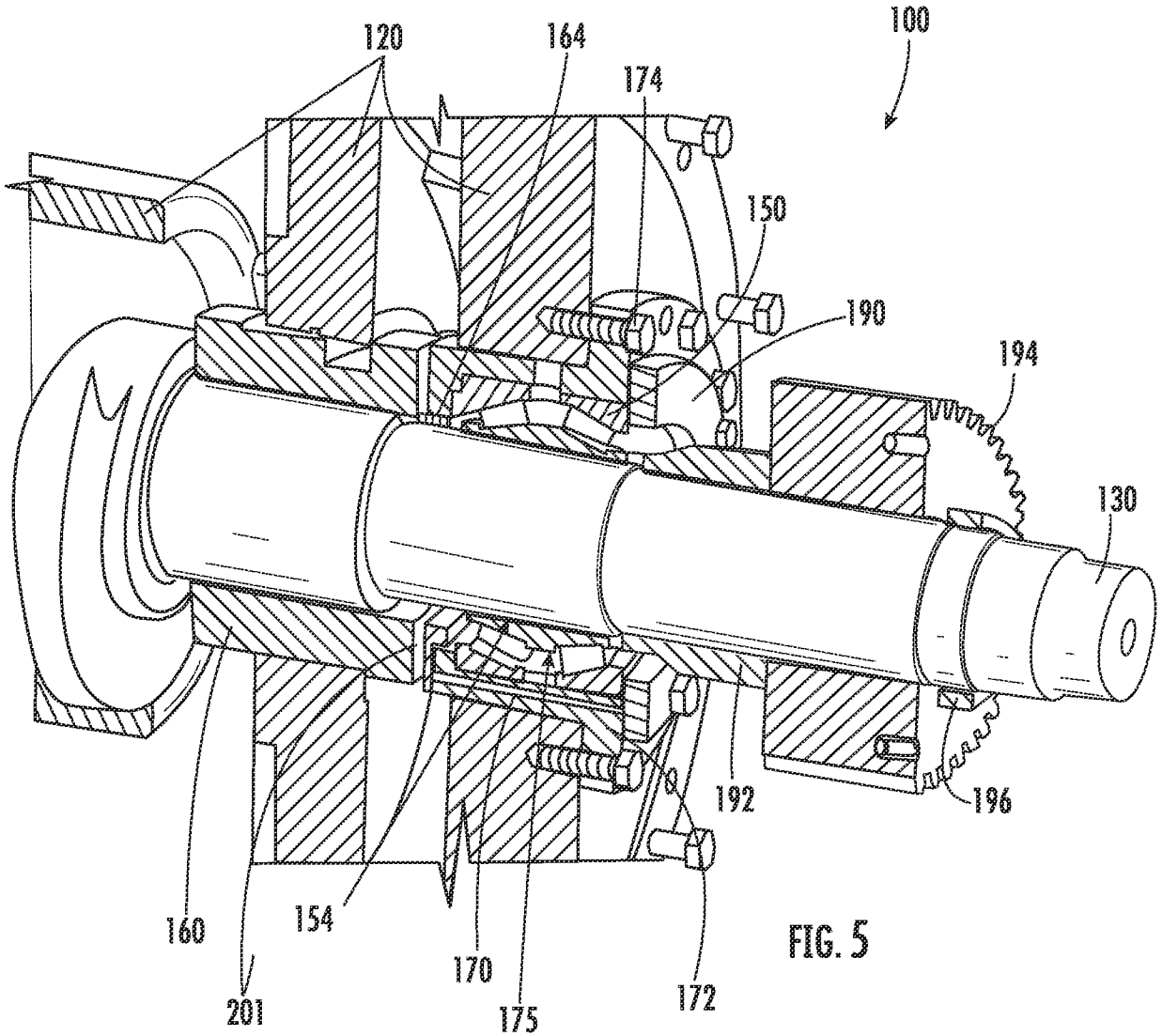
FIG. 5 is a detailed, perspective view of the bearing seal assembly shown in FIG. 3.

In addition, as generally illustrated in FIG. 3, the screw pump 100 may also include one or more oil seals 180 positioned between the seal 160 and bearing 150, oil rings 182 positioned between a flange 172 and the casing 120, an outer retaining plate 190, an inner retaining spacer 192, a gear 194, and a lock nut 196.

In one embodiment, the bearing 150 is coupled to the rotor 130 and the casing 120 via a bearing pod 170. In one embodiment, as illustrated, the bearing pod 170 includes a flange 172 arranged and configured to engage the casing 120. The flange 172 may be positioned at one end of the bearing pod 170. The bearing pod 170 may be arranged and configured to engage the casing 120 by any suitable mechanism now known or hereafter developed. For example, as shown, the bearing pod 170 is arranged and configured to engage the casing 120 via a plurality of bolts 174. While the bearing 150 and bearing pod 170 are shown and described as being two separate and distinct components, one of ordinary skill in the art will appreciated that they may be formed and/or provided as a single component and thus may be referred to herein as a bearing assembly.

As shown, in one example of an embodiment where the bearing pod 170 and bearing 150 are provided as two separate components, the bearing pod 170 includes a cavity, bore, recess, etc. 175 sized and configured to receive the bearing 150. Similarly, as will be appreciated by one of ordinary skill in the art, the bearing 150 includes a bore 154 for enabling passage of the rotor 130 therethrough. Thus arranged, the bearing pod 170, when fastened to the casing 120, secures the position of the bearing 150 and the rotor 130. The bearing 150 arranged and configured to enable the rotor 130 to rotate relative to the casing 120.

In addition, as illustrated, in one embodiment, the seal 160 is positioned between the rotor 130 and the casing 120. As illustrated, the seal 160 is positioned inboard of the bearing 150 about the rotor 130. In accordance with one aspect of the present disclosure, the seal 160 is arranged and configured to engage, couple, attach, etc. (terms used interchangeably herein without the intent to limit) to the bearing assembly. Thus arranged, the seal 160 need not be separately and independently fastened (e.g., bolted) to the casing 120. That is, in accordance with one aspect of the present disclosure, the seal 160 does not include a flange for fastening (e.g., bolting) the seal 160 to the casing 120. Thus arranged, the seal 160 and the bearing assembly (e.g., the bearing 150 and the bearing pod 170) may be referred to as a bearing seal assembly.

The seal 160 may be arranged and configured to engage the bearing assembly by any suitable mechanism now known or hereafter developed such as, for example, via fasteners (e.g., bolts), adhesive, etc. In one example of an embodiment, the seal 160 may include an axially extending projection or ledge 164. In use, the bearing assembly such as, for example, the bearing pod 170, may be arranged and configured to receive the axially extending projection or ledge 164. For example, as shown, the axially extending projection or ledge 164 may be received by the bore 175 formed in the bearing pod 170. The axially extending projection or ledge 164 may be received by the bearing pod 170 at the end opposite the flange 172. Thus arranged, the seal 160 may be coupled to the screw pump 100 via forces transferred from the bearing assembly. That is, the seal 160 may be coupled to the casing 120 via compressive forces induced by coupling (e.g., bolting) the bearing assembly to the casing 120 (e.g., fasteners used to secure the bearing assembly (e.g., bearing pod 170) to the casing 120 may also be used to secure the seal 160 via the interlocking and/or abutting surfaces between the seal 160 and the bearing assembly. As such, the flange 172 formed on the bearing assembly may be used to secure both the seal 160 and the bearing 150 to the casing 120 (e.g., no need to independently fasten (e.g., bolt) the seal to the casing). In addition, as generally illustrated, in one embodiment, the seal 160 may include an outer diameter that is less than the outer diameter of the bearing assembly (e.g., outer diameter of the portion of the bearing assembly surrounding the rotor 130).

Thus arranged, by providing a bearing seal assembly (e.g., by providing an assembly where the seal 160 is coupled to or operatively associated with the bearing assembly), easier maintenance is readily achieved. First, because the seal 160 is not separately and independently fastened (e.g., bolted) to the casing 120, removal of the seal 160 can be achieved through the access space created when the bearing assembly is removed. That is, contrary to known prior art screw pumps which utilize a seal including a flange for fastening to the casing and thus, in order to remove the seal, the entire side of the screw pump must be disassembled, in accordance with aspects of the present disclosure, the seal of the bearing seal assembly of the present disclosure can be removed and replaced through the access space created by removing the bearing 150 (e.g., that is, in use, the bearing 150 can be unfastened from the casing 120 and removed, this in turn creates enough space for the seal 160 to be removed from the casing 120, the seal can be moved in and out through the space created by removing the bearing without the need to remove the bearing cover and the bearing associated with the second rotor).

In addition, by coupling the seal 160 to the bearing assembly, the seal 160 may be removed in unison with the bearing assembly. That is, after unfastening the bearing assembly from the casing, removing the bearing assembly may also simultaneously remove the seal since the seal and the bearing assembly are coupled to each other.

Figure 6:
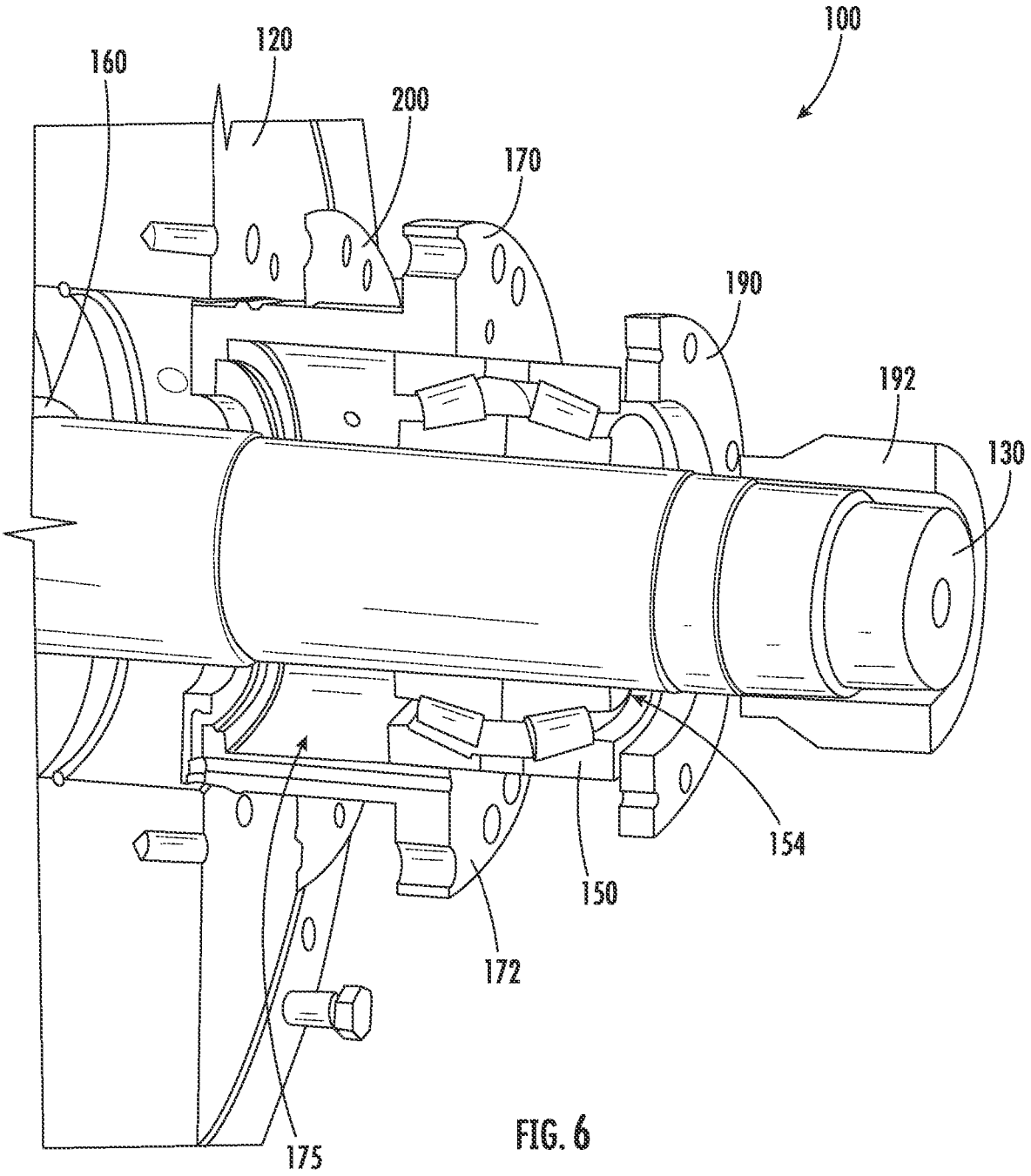
FIG. 6 is a detailed, partial exploded view of the bearing seal assembly shown in FIG. 3.
Figure 7:
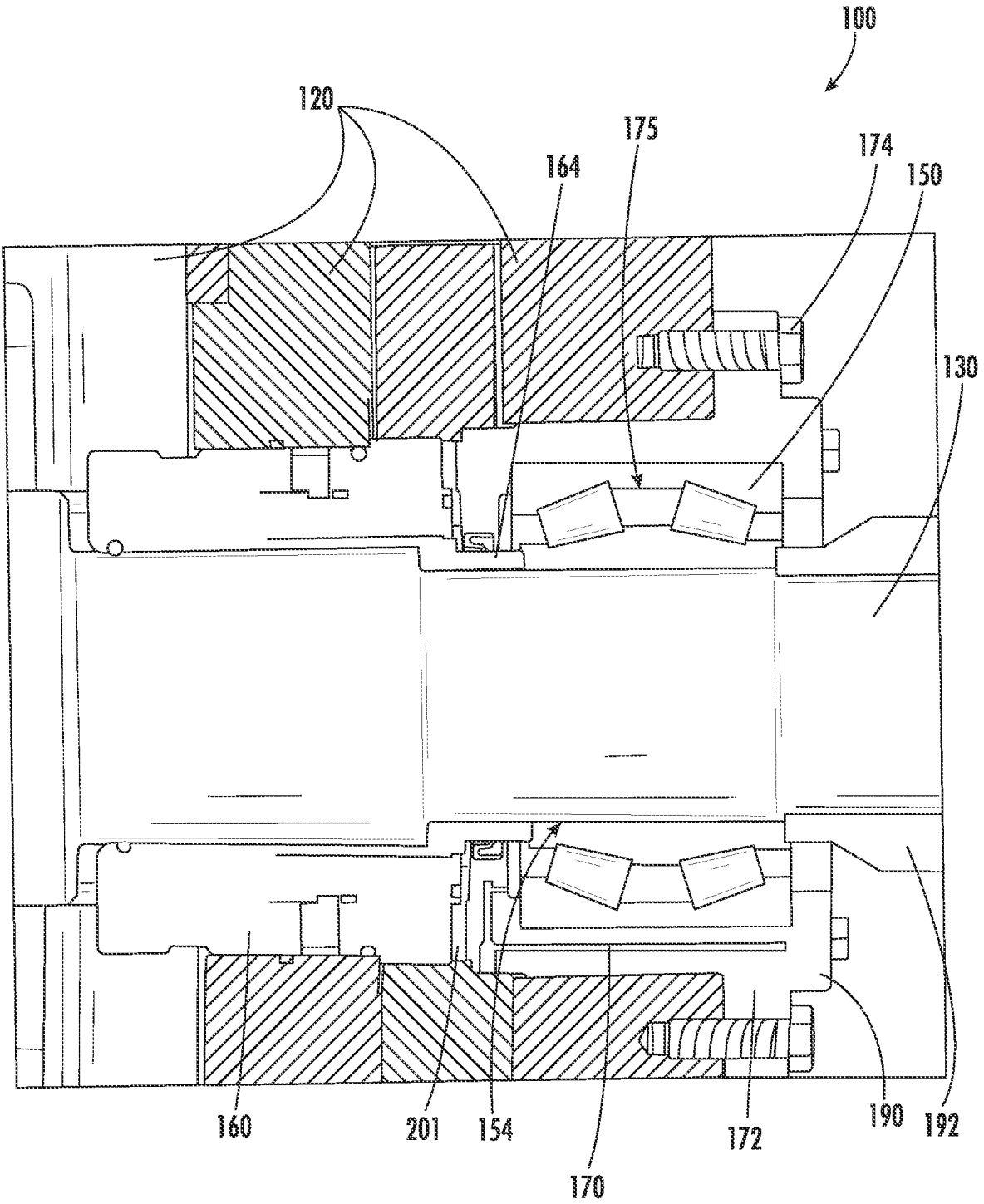
FIG. 7 is a detailed view of the bearing seal assembly shown in FIG. 3.
Figure 8:
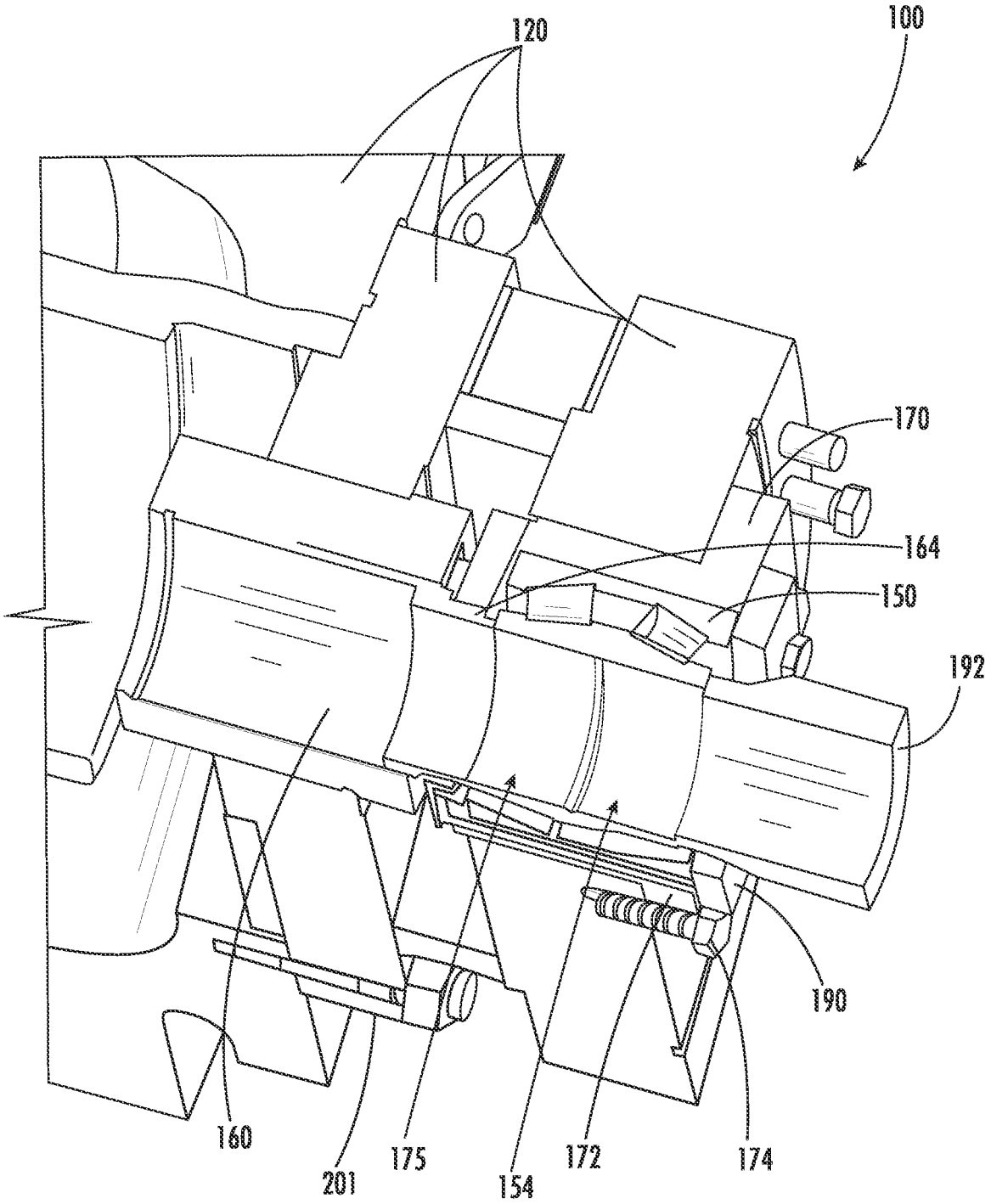
FIG. 8 is a detailed view of the bearing seal assembly shown in FIG. 3.

In addition, and/or alternatively, in accordance with another aspect of the present disclosure, the bearing seal assembly may include a shim 200 (FIGS. 3 and 6). As illustrated, in one example of an embodiment, the shim 200 may be positioned between the casing 120 and the bearing assembly (e.g., bearing pod 170). By positioning one or more shims 200 between the casing 120 and the bearing assembly, the axial position of the rotor 130 can be adjusted to, for example, align the threaded shape profiling in the first and second rotors as needed. In accordance with the various aspects of the present disclosure, the axial position of the rotor 130 can be accomplished after bearing assembly (e.g., rotor axial position and shimming can be adjusted without disassembly of the bearing). In one example of an embodiment, the shim 200 may be provided into two parts to allow easier positioning, although it is envisioned that the shim may be provided as a single piece, or as three or more pieces. In addition, one or more shims 201 may be utilized between the seal 160 and the bearing 150 (e.g., bearing pod 170) in order to control a position of the seal 160.

By providing an integrated bearing seal assembly as described herein, a number of additional advantages can also be obtained. For example, installation and maintenance is improved by introducing a single point of access for the bearing assembly and the seal thereby decreasing complexity of tear down, which reduces associated time and cost (e.g., the bearing seal assembly enables easier site removal and installation since all work can be performed through the access space created by removing the bearing assembly). In addition, each seal may be independently removed and replaced without the need to remove other bearings and/or the bearing housing (e.g., the seal associated with the first rotor can be accessed, removed, and replaced by removing the outboard bearing assembly associated with the first rotor, need to remove the bearing associated with the second rotor is eliminated). Installation and/or removal requires reduced bolting and unbolting, respectively, thus reducing associated time and cost (e.g., independent bolting of the seal is eliminated).

Moreover, by removing the necessity to separately and independently fasten (e.g., bolt) the seal to the casing, a more compact design is achieved, which in turn allows for a reduced bearing span (e.g., reduced axial distance between bearings positioned on opposite sides of the same rotor) and thus stiffer rotors.

Figure 9:
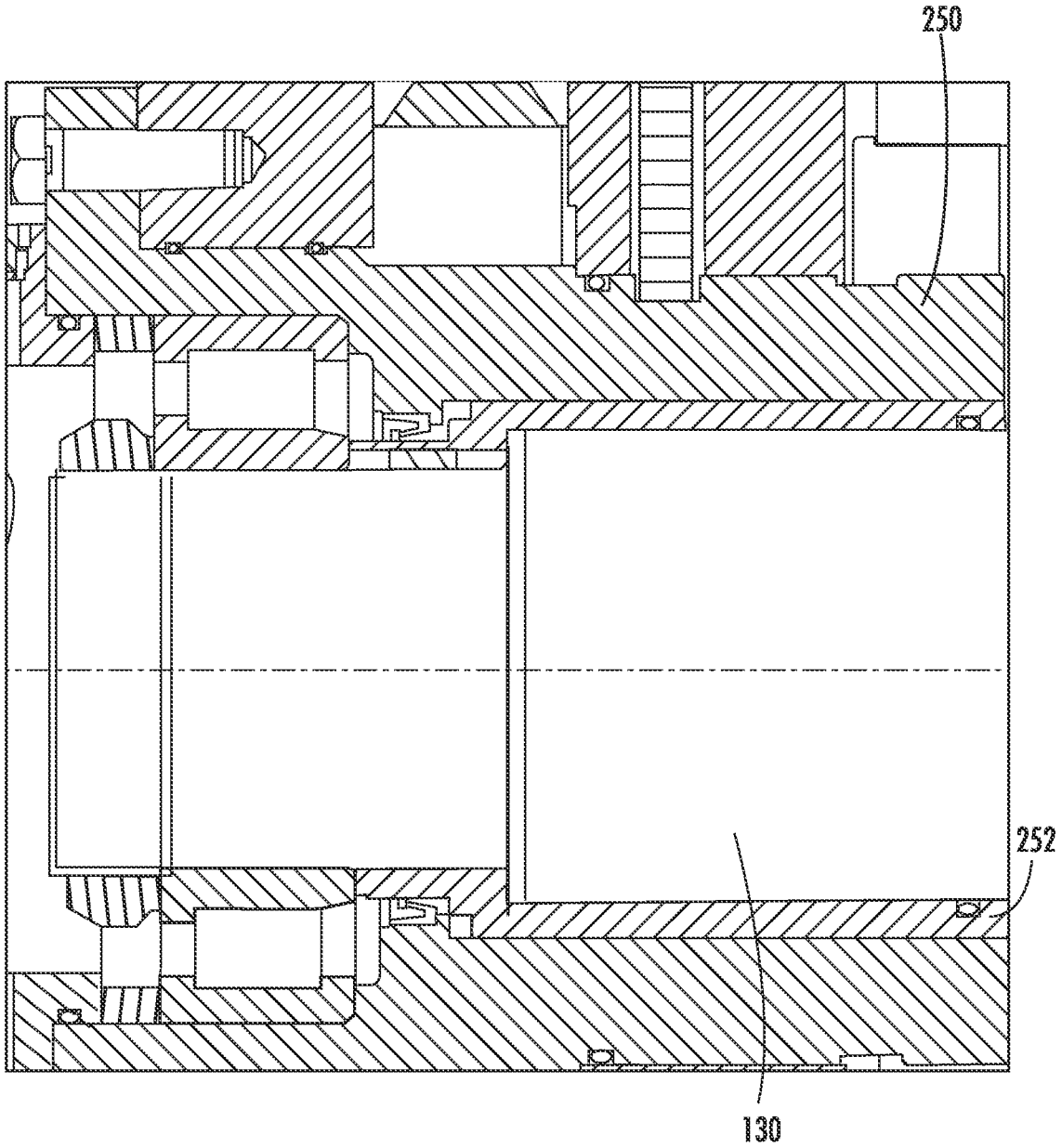
FIG. 9 is a detailed view of an alternate embodiment illustrating an integrated bearing seal housing.

In one embodiment, referring to FIG. 9, an integrated bearing seal housing 250 may be provided to form a single cartridge. In use, the bearing seal housing 250 may be a mechanical seal with an integrated bearing bore formed in the gland. The bore being sized and configured to enable the rotor 130 and a rotating mechanical seal or sleeve 252 to pass therethrough. Thus arranged, the cartridge 250 may be preset so that installation may be achieved without any needed adjustments of the seal after installation.

In additional, and/or alternatively, in one example of an embodiment, the seal and bearing may be arranged and configured to utilize the same lubricant such as, for example, a mineral oil, a fluidlike PAG, or the like. In one embodiment, this can be achieved by removing the lip seal or isolator separating the bearing from the seal to enabling fluid communication between the seal and bearing.

Figure 10:
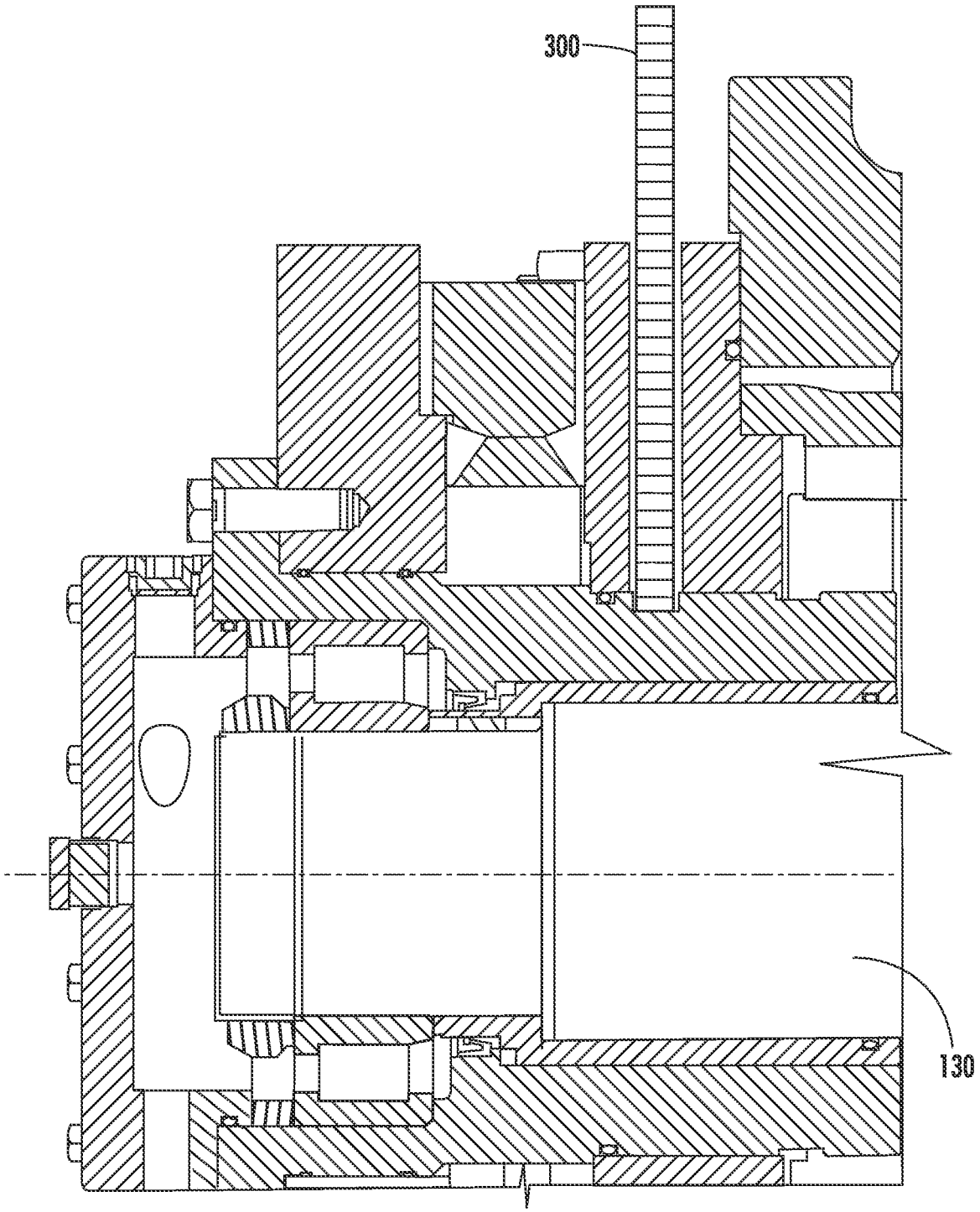
FIG. 10 is a detailed view of an alternate embodiment illustrating a bearing seal assembly equipped with a radial locking pin.

In addition, and/or alternatively, referring to FIG. 10, in order to facilitate installation, removal and securement of the seal during bearing removal, the bearing seal assembly can be equipped with a locking pin 300 that can be loosened and removed radially. Alternatively, a tool can be introduced through the radial seal oil supply bores drilled in the pump cover. In either event, these methods remove the need to access traditional mechanical seal locking clips which can be very difficult in some pumps.

While the present disclosure refers to certain embodiments, numerous modifications, alterations, and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof. The discussion of any embodiment is meant only to be explanatory and is not intended to suggest that the scope of the disclosure, including the claims, is limited to these embodiments. In other words, while illustrative embodiments of the disclosure have been described in detail herein, it is to be understood that the inventive concepts may be otherwise variously embodied and employed, and that the appended claims are intended to be construed to include such variations, except as limited by the prior art.

The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

The phrases "at least one", "one or more", and "and/or", as used herein, are open-ended expressions that are both conjunctive and disjunctive in operation. The terms "a" (or "an"), "one or more" and "at least one" can be used interchangeably herein. All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., engaged, attached, coupled, connected, and joined) are to be construed broadly and may include intermediate members between a collection of elements and relative to movement between elements unless otherwise indicated. As such, connection references do not necessarily infer that two elements are directly connected and in fixed relation to each other. All rotational references describe relative movement between the various elements. Identification references (e.g., primary, secondary, first, second, third, fourth, etc.) are not intended to connote importance or priority but are used to distinguish one feature from another. The drawings are for purposes of illustration only and the dimensions, positions, order and relative to sizes reflected in the drawings attached hereto may vary.

What is claimed is:

1. A screw pump comprising:

a casing including an internal chamber;

first and second rotors rotatably positioned within the chamber of the casing, the first and second rotors including intermeshing threaded-shape profiling; and a plurality of bearing seal assemblies, a bearing seal assembly positioned at each end of the first and second rotors, each bearing seal assembly including:

a bearing positioned about an end portion of a respective one of the first rotor or the second rotor to facilitate rotation of the respective one of the first rotor or the second rotor; and a seal positioned about an end portion of the respective one of the first rotor or the second rotor to seal passage of the respective one of the first rotor or the second rotor through the casing;

wherein the seal includes an axially extending projection and the bearing is arranged and configured to receive the axially extending projection; and wherein the bearing is coupled to the seal so that the seal is secured to the casing via compressive forces induced by a coupling of the bearing to the casing.

2. The screw pump of claim 1, wherein the seal is positioned on the end portion of the respective one of the first rotor or the second rotor inboard of the bearing.

3. The screw pump of claim 1, wherein the seal is not separately and independently fastened to the casing.

4. The screw pump of claim 1, wherein the seal includes an outer diameter and the bearing includes an outer diameter, the outer diameter of the seal is less than the outer diameter of the bearing.

5. The screw pump of claim 1, wherein the seal is accessible via an access space created by removal of the bearing.

6. The screw pump of claim 1, wherein the seal and the bearing are arranged and configured to be removed from the casing in unison.

7. The screw pump of claim 1, further comprising a shim positioned between the bearing and the casing, the shim being arranged and configured to adjust an axial position of the respective one of the first rotor or the second rotor.

8. The screw pump of claim 1, further comprising one or more additional shims positioned between the seal and the bearing, the one or more additional shims arranged and configured to control a position of the seal.

9. The screw pump of claim 1, wherein the bearing includes a bearing pod having a flange arranged and configured to receive a plurality of fasteners for coupling the bearing seal assembly to the casing.

10. The screw pump of claim 9, wherein the bearing pod includes a cavity sized and configured to receive the bearing therein.

11. The screw pump of claim 10, wherein the seal includes an axially extending projection, the axially extending projection is received within a bore formed in the bearing pod.

12. The screw pump of claim 11, wherein the flange is positioned at one end of the bearing pod, the bore for receiving the axially extending projection is positioned at an opposite end of the bearing pod from the flange.

* * * * *